United States Patent [19]

Yoshida

[11] 4,109,807

[45] Aug. 29, 1978

[54] SUPPORT FOR LOADER LIFT ARM

[75] Inventor: Yasuhiko Yoshida, Teraimachi, Japan

[73] Assignee: Kabushiki Kaisha Komatsu Seisakusho, Tokyo, Japan

[21] Appl. No.: 739,350

[22] Filed: Nov. 5, 1976

[30] Foreign Application Priority Data

Nov. 6, 1975 [JP] Japan ..... 50-150214[U]

[51] Int. Cl.[2] ..... E02F 3/36

[52] U.S. Cl. ..... 214/131 R; 214/776; 298/17 B

[58] Field of Search ..... 214/131 R, 140, 776; 212/39 R, 39 B, 59 A, 63; 298/17 B; 187/8.49

[56] References Cited

U.S. PATENT DOCUMENTS

| | | | |
|---|---|---|---|
| 3,091,346 | 5/1963 | Yawn | 212/63 X |
| 3,353,699 | 11/1967 | Svoboda | 214/776 |
| 3,360,146 | 12/1967 | Borer et al. | 214/776 |
| 3,396,863 | 8/1968 | Borer et al. | 214/776 |
| 3,918,601 | 11/1975 | Zimmerman | 214/776 |

FOREIGN PATENT DOCUMENTS

| | | | |
|---|---|---|---|
| 1,063,833 | 12/1953 | France | 298/17 B |

*Primary Examiner*—L. J. Paperner

*Attorney, Agent, or Firm*—Armstrong, Nikaido, Marmelstein & Kubovcik

[57] ABSTRACT

A support for lift arms of a tractor mounted loader comprising a tractor frame, lift arms for supporting a loader bucket, said lift arms being pivotally mounted to said frame of the tractor, a pin embedded in said lift arm, and a link pivotally mounted to said frame of the tractor said link having an opening formed therein which is engageable with said pin and also a relatively small hole formed therein wherein said link is adapted to be accommodated on said frame when said lift arms are lowered.

3 Claims, 3 Drawing Figures

18
21
20
12
14
19
26
22
27
25
17
23
28
15
13
10
11
16

SUPPORT FOR LOADER LIFT ARM

BACKGROUND OF THE INVENTION

This invention relates to latch means for holding lift arms of tractor mounted loaders in the raised position.

It becomes sometimes necessary to raise the lift arms of a loader to enable the operator to effect maintenance and repairs at the forward end of the loader tractor.

Since the operator effecting such work is endangered by the mass of the arms suspended above them, it has been a common practice to latch or lock the arms in their raised position so that they can not be sustained only by hydraulic circuits, failure of which results in falling of them. Various devices have been proposed to hold loader lift arms in their raised position and one such device which has proved effective is disclosed in U.S. Pat. No. 3,353,699. In said patent, a latch mechanism is provided to hold lift arms in their raised position so as to prevent an accidental falling of the lift arms. Locking and unlocking of the latch mechanism in said patent, however, must be performed outside the driver's cab due to the configuration and arrangement thereof.

SUMMARY OF THE INVENTION

It is, therefore, an object of the present invention to provide an improved support means for lift arms of a loader which can be easily operated and which does not impose high stresses on the components.

Another object of the present invention is to provide support means for lift arms of a loader wherein locking and unlocking of the support means can be easily carried out by the operator from inside the driver's cab.

The present invention is directed to a support for lift arm of a tractor mounted loader which comprises a tractor frame, lift arms for supporting a loader bucket, said lift arms being pivotally mounted on said tractor frame, a pin embedded in said lift arm, a link pivotally mounted on said tractor frame, said link having an opening engageable with said pin when said lift arms are in raised position and a relatively small hole formed therein, and means provided on said frame for selectively engageable with said hole for the accommodation, of said link when said lift arms are in their lowered positions.

Other objects, features and advantages of the present invention will be readily apparent from the following description taken in conjunction with the following drawings.

DETAILED DESCRIPTION OF THE PREFERRED EMBODIMENT

The present invention will now be described in detail below by way of an example with reference to the accompanying drawings.

Figure 1:
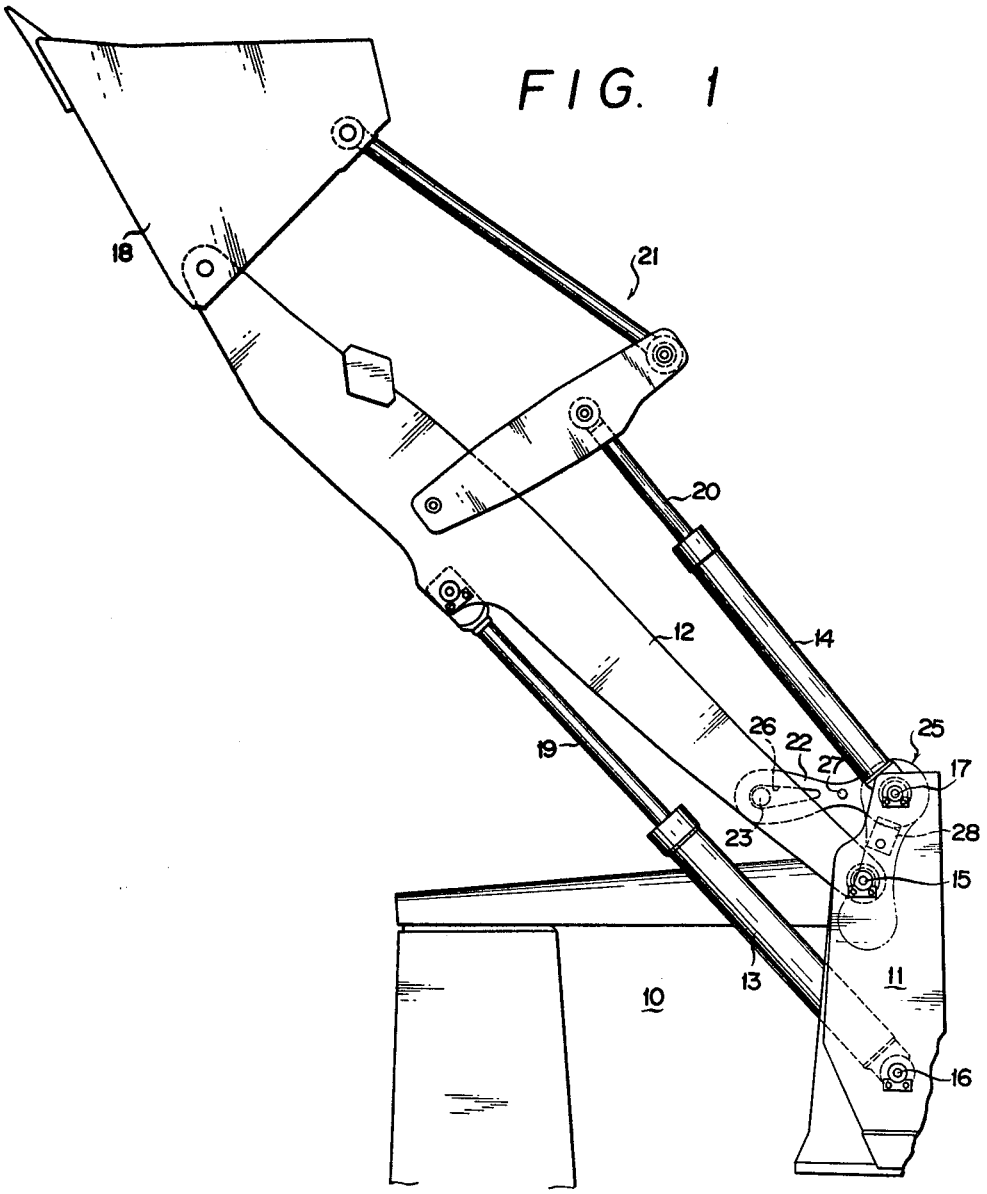
FIG. 1 is a side elevational view of a loader showing only the forward portion of the tractor upon which it is mounted and showing the support of the present invention.
Figure 2:
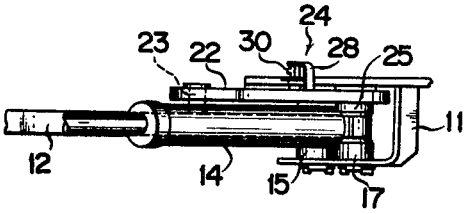
FIG. 2 is an enlarged plan view of the support of the present invention.
Figure 3:
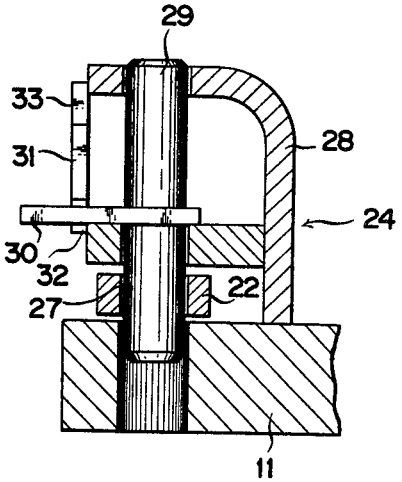
FIG. 3 is an enlarged cross-sectional view of means for accommodating the support of the present invention.

In FIG. 1, reference numeral 10 denotes an engine compartment mounted in the forward part of the vehicle. Located behind the engine compartment 10 are U-shaped frames 11 (only one of which is shown) defining a driver's cab (not shown). The U-shaped frames 11 have pivots 15, 16 and 17 to which a pair of lift arms 12, lift cylinders 13 and tilt cylinders 14 are pivotally mounted, respectively. A bucket 18 is pivotally mounted to the leading ends of the pair of upwardly and downwardly movable and oscillatory lift arms 12. The pair of lift cylinders 13, each of which is connected to a piston rod 19, serve to raise and lower the lift arms 12. Each of the pair of tilt cylinders 14 has a piston rod 20 which is connected through a linkage 21 for tilting movement to the bucket 18 thereby effecting tilting movement of the latter.

The foregoing description is concerned with the prior art arrangement of such a mechanism. The present invention is characterized by the provision of a mechanical latch mechanism located between the U-shaped frames 11 and the lift arms 12 for the purpose of preventing dropping of the latter.

The latch mechanism comprises U-shaped frames 11 which support lift arms 12, an oscillatory latch link 22, a pin 23 which connects the latch link 22 to the lift arms 12 and holding pin means 24 which holds the latch link 22 in an accommodating position. The latch link 22 located in position between the U-shaped frames 11 and the lift arms 12 supported at three places serve to lock the counterclockwise oscillation of the lift arms 12.

Stating in brief, an oscillating centre 25 is provided in the U-shaped frames 11 at a position spaced apart above the oscillating centre 15 of the lift arms 12 (coaxially with the oscillating centre 17 of the tilt cylinders 14 in the drawings), and the latch link 22 is located so that it can be freely moved in the vertical and horizontal directions. The latch link 22 has a hook portion or an opening 26 and a hole 27 through which the holding pin is passed as shown.

Fixedly secured to the lift arms 12 is a connecting pin 23 which can be engaged with the hook portion 26 of the latch link 22 when the lift arms 12 are raised near the highest position thereof. Further, there is provided a holding pin means 24 which holds the latch link 22 when the latter is accommodated in the position shown by two-dot broken line, and which is inserted into the hole 27. The holding pin means 24 comprises a holding pin 29, a bracket 28 secured to the U-shaped frame 11 so as to carry the holding pin 29 and a slide lever 30 secured to the holding pin 29 at right angles thereto so as to effect sliding and guiding movements in the axial direction. The free sliding movement of the holding pin 29 is prevented by restricting the movement of the slide lever 30 between a locking position 32 and an unlocking position 33 by means of a lock plate 31 formed as an integral part of the bracket 28.

Since the present invention is constructed as mentioned hereinabove, the falling or dropping of the lift arms 12 in the counterclockwise direction can be locked by oscillating the latch link 22 freely and engaging the hook portion 26 of the latter with the connecting pin 23 of the lift arms 12 which has been raised near the highest position thereof. The locking operation can be effected safely by the operator without leaving the driver's seat. Further, when it is desired to effect unlocking, it is only required for the operator sitting on the driver's seat to move the lift arms 12 upwardly and allow the latter to oscillate slightly clockwise thereby oscillating the latch link 22 and changing the position of engagement of the latch link 22 with the connecting pin 23. As a result, the load of the lift arms 12 imposed on the latch link 22 is released so that the latch link 22 can be oscillated in the horizontal direction and disengaged from the connecting pin 23. This operation can also be effected readily by the operator without leaving the driver's seat.

It is to be understood that the foregoing description is merely illustrative of the preferred embodiment of the invention and that the scope of the invention is not to be limited thereto, but is to be determined by the scope of the appended claims.

I claim:

1. A support for lift arms of a tractor mounted loader comprising a tractor frame, lift arms for supporting a loader bucket, said lift arms being pivotally mounted on said tractor frame, a pin embedded in said lift arm, a link pivotally mounted on said tractor frame at a point above the pivotal mount of said lift arm on said tractor frame, said link having an elongated first hole to facilitate engagement with said pin when said lift arms are raised and a relatively small second hole formed therein, and means provided on said frame for selectively engageable with said second hole for the accomodation of said link when said lift arms are lowered.

2. A support for lift arms of a tractor mounted loader of claim 1 wherein said means comprises a bracket mounted on said frame, and a second pin axially supported by said bracket, said second pin being selectively extensible into a hole formed in said frame through the hole in said link so as to accommodate said link on said tractor frame when said lift arms are lowered.

3. A support for lift arms of tractor mounted loader of claim 1 wherein said link is coaxially pivoted with one end of a tilt cylinder for tilting the loader bucket, said one end of the tilt cylinder being pivotally mounted between said tractor frame and said loader bucket.

* * * * *